US005505626A

United States Patent [19]

Grabbe et al.

[11] Patent Number: 5,505,626

[45] Date of Patent: Apr. 9, 1996

[54] ELECTRICAL CONNECTOR WITH TENSION ADJUSTING MEANS

[75] Inventors: Dimitry G. Grabbe, Middletown; Michael F. Laub, Etters, both of Pa.

[73] Assignee: The Whitaker Corporation, Wilmington, Del.

[21] Appl. No.: 299,222

[22] Filed: Aug. 31, 1994

[51] Int. Cl.[6] ..... H01R 9/09

[52] U.S. Cl. ..... 439/62; 439/67

[58] Field of Search ..... 439/62, 65, 67, 439/493, 632

[56] References Cited

U.S. PATENT DOCUMENTS

| | | | |
|---|---|---|---|
| 4,552,420 | 11/1985 | Eigenbrode | 439/65 |
| 4,934,942 | 6/1990 | Casciotti | 439/65 |
| 4,969,824 | 11/1990 | Casciotti | 439/62 |
| 5,102,342 | 4/1992 | Marian | 439/65 |
| 5,171,154 | 12/1992 | Casciotti et al. | 439/67 |

OTHER PUBLICATIONS

AMP Incorporated, Product Information Bulletin 65188, AMP–ASC Interconnection Systems, Feb. 27, 1992, pp. 1–4.

*Primary Examiner*—Gary F. Paumen
*Assistant Examiner*—T. C. Patel
*Attorney, Agent, or Firm*—William B. Noll

[57] ABSTRACT

This invention relates to a card edge or backplane type electrical connector, where typically two or more planar electronic devices, such as a mother board and one or more daughter boards, are electrically interconnected usually by arranging the daughter board(s) perpendicular to the mother board. The electrical connector of this invention comprises a pair of opposed housing members having a slot defined by opposing facing surfaces extending therebetween to receive a first of the planar electronic devices or daughter board, where housing member consists of first and second members floatably mounted to one another by spring means urging the first and second members away from one another. Force applying means, preferably in the form of a series of elongated canted coil spring is provided in the housing members along the facing surfaces. Further, a flexible circuit film member for each housing member, having spaced apart rows of contact pads on a surface thereof, is wrapped about a respective first and second member and force applying means, where the contact pads are exposed to the slot. By this arrangement, and by ensuring the separating force of the spring means is greater than the insertion or frictional force required to place the daughter board within the slot, localized and damaging flexing of the circuit film is avoided.

10 Claims, 6 Drawing Sheets

ELECTRICAL CONNECTOR WITH TENSION ADJUSTING MEANS

BACKGROUND OF THE INVENTION

This invention is directed to an improved high density, backplane connector of the type taught in U.S. Pat. Nos. 4,969,824 and 5,171,154, incorporated herein by reference, and assigned to the assignee hereof. The prior art generally describes a pair of one-piece connector housing members, arranged for mounting to a first planar electronic device, such as a motherboard, where such housing members are spaced apart to define a slot for receiving a second planar electronic device, such as a daughter board, to be electrically interconnected to said mother board. In a commercial embodiment of the invention, the respective housings faces, adjacent the planar electronic devices, include channels for receiving a coiled spring, and a flexible film, having electrical circuitry or traces thereon, wrapped about the housing members and coiled springs. The coiled springs provide a normal force to the film to ensure electrical contact with the respective planar electronic devices.

Experience has shown that connectors of this type may exhibit some difficulties with longevity in terms of the number of insertions by the daughter board, as well as reliability of making good electrical connections. One of such difficulties is associated with the nature of the flexible film, and the copper circuitry thereon. Such difficulty is addressed in the co-pending application, Ser. No. 08/292,221 dated Aug. 31, 1994, filed concurrently with this application. For a detailed discussion of the problems overcome in the co-pending application, reference may be made thereto, where such co-pending application is incorporated herein in its entirety. Briefly stated, there is a tendency for the copper circuitry or traces to work harden resulting in stress cracking and/or flaking thereof leading to poor or failed electrical continuity.

In any case, with the type of connector of this invention, as the daughter board is pushed into position within the slot created by the opposed housing members, its front edge deflects the flexible film towards the housing. As the daughter board moves incrementally into position adjacent the mother board, it will encounter the mechanical resistance associated with the compression of the first coil spring in the assembly. This will create a local sharp deformation of the foil, an event which will repeat as many times as there are coil springs in the assembly. Simultaneously, the distance from the center of any pad or trace to the mother board will decrease somewhat due to the gradual assumption of a straight line shape of the flexible circuit. This movement of the buckling wave starting with the first wave until the end, creates stress fatigue and cracking of the copper conductors, which of necessity are made of relatively soft copper, but which work harden.

While the co-pending application addresses the problem of local compliance, i.e. compliance between adjacent conductors or traces in close proximity to one another, the fundamental problem of the buckling wave is not completely eliminated. The present invention thus proposes a connector construction which will satisfy the fundamental requirement of keeping the flexible film under tension so that the frictional force of card insertion exerted on the flexible film would be smaller than the tension force. Thus, when the daughter board is inserted and compression of the connector is taking place, the "extra length" of the flexible film is accommodated by a motion of the flexible film in the direction opposite that of the daughter board insertion. In this manner, the flexible film will not be forming a buckling wave and therefore the conductors will not be subjected to fatigue stress cracking. The present invention accomplishes this by having the respective housings of the connector made in two pieces with a spring or separating means to counteract the force of insertion. The advantages of the present invention will become apparent to those skilled in the art from a reading of the following specification, particularly when read in conjunction with the accompanying drawings.

SUMMARY OF THE INVENTION

This invention is directed to a high density electrical connector of the type known in the art as a backplane or card edge connector, where the connector generally connects two planar electronic devices perpendicularly to one another. The connector comprises a pair of opposed housing members, typically mirror images of one another, having a slot therebetween defined by opposing facing surfaces to receive a first of the planar electronic devices. Each housing member consists of first and second members, where the second member is floatably mounted to the first member by spring means urging the first and second members away from one another. A force applying means, such as elongated coil springs is associated with each facing surface. Further, a flexible circuit film member for each of the housing members is provided, where the film includes spaced apart rows of contact pads on a surface thereof, and the film member is wrapped about a respective first and second member and the force applying means in a manner to expose the contact pads to the slot. By ensuring the separating force of the spring means to be greater than the insertion or frictional force required to place the first planar electronic device within the slot, localized flexing of the film is avoided, where repeated localized flexing may damage the contact pads thereon.

DETAILED DESCRIPTION OF PREFERRED EMBODIMENT

The present invention is directed to a high density electrical connector of the type for mounting a first planar electronic device, such as a daughter board, to a second planar electronic device, such as a mother board, where the respective devices are electrically interconnected through a connector typically secured to one of said devices. The general arrangement of this type of connector, also known as a card edge or backplane connector, is illustrated in U.S. Pat. Nos. 4,969,824 and 5,171,154.

Figure 1:
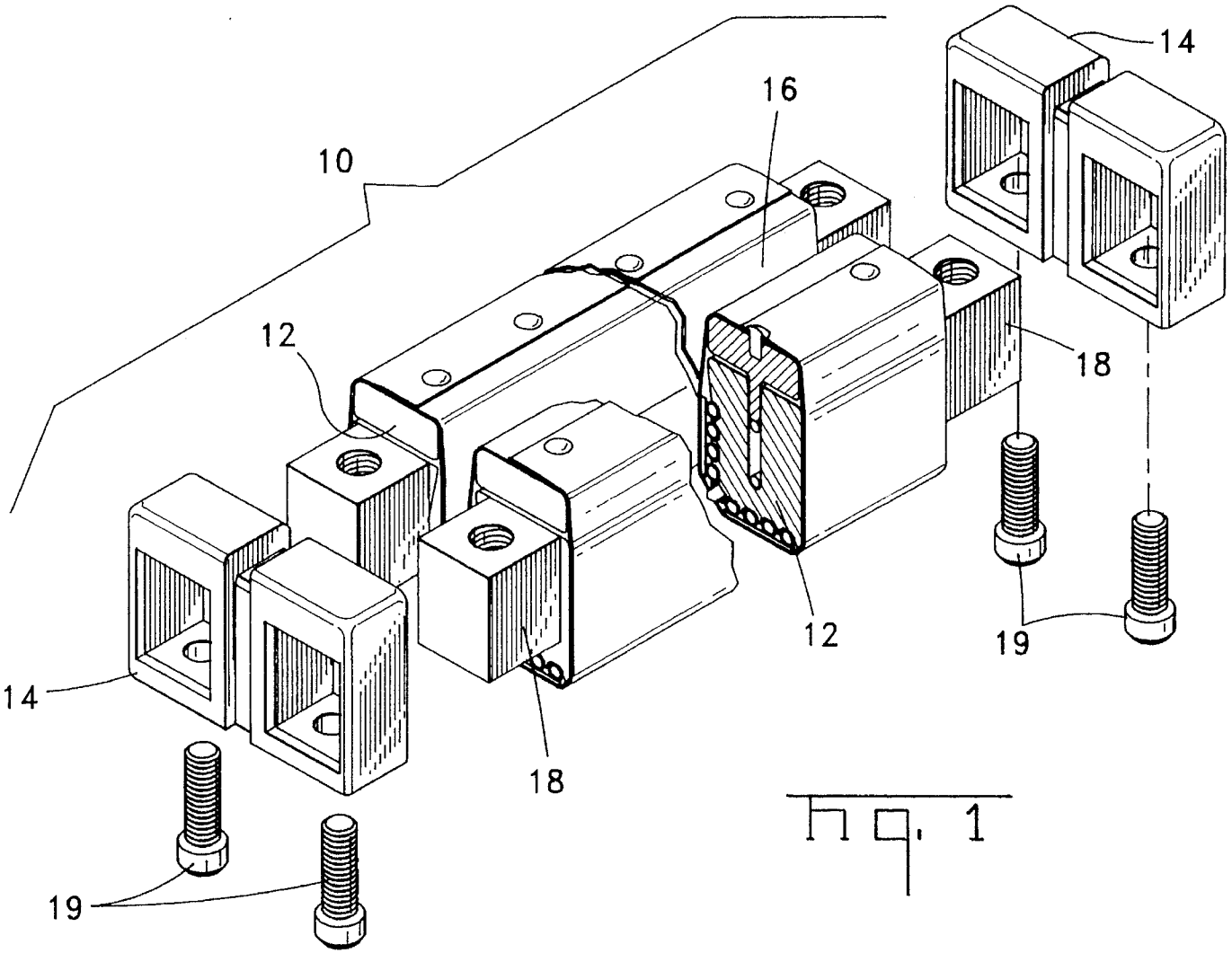
FIG. 1 is an exploded perspective view of a high density, backplane type connector incorporating a tension adjusting means according to the invention, where portions of the connector housing has been removed to illustrate certain internal details thereof.

FIG. 1 illustrates, in an exploded fashion, a high density electrical connector 10 utilizing the teachings of this invention. The connector of FIG. 1 includes a pair of connector housing members 12, typically elongated, which are essentially identical in configuration. The two housing members 12 may be joined by end blocks 14 to form a unitary member having a longitudinal slot 16 between the respective housing members. Though not illustrated, the slot 16 is intended to receive the first planar electronic device, or daughter board, in the manner of the prior art described above.

The assembled connector, that is with the end blocks 14 positioned over the housing extensions 18, may be secured to a second planar electronic device, such as a mother board (not illustrated), by threaded fasteners 19. Such a manner of mounting or securing is well known in the art.

For a detailed explanation of the respective housing members 12, reference is made to the several embodiments of FIGS. 2–5. Since the respective housing members 12 are essentially identical in configuration, or rather mirror images of one another, the further description will be limited to a single housing member 12.

Each housing member 12 comprises first and second members, 12*a* and 12*b* respectively, where the second or upper member 12*b* is floatably mounted to said first or lower member 12*a*. The housing members may be made of extended aluminum or a molded plastic, as known in the art. Each first member, along a slot face 20 and base face 22 is provided with one or plural grooves 24 which typically extend the length of the connector 10, i.e. between end blocks 14. Within said grooves, a canted coil spring 26 is provided. Canted coil springs are preferred and are made and sold by the Bal Seal Engineering Company Inc. of Santa Ana, Calif. These springs have a high degree of deflection with the force remaining nearly constant over the working range of deflection due to being canted. For a further understanding thereof, reference is made to U.S. Pat. No. 4,969,824.

Figure 2:
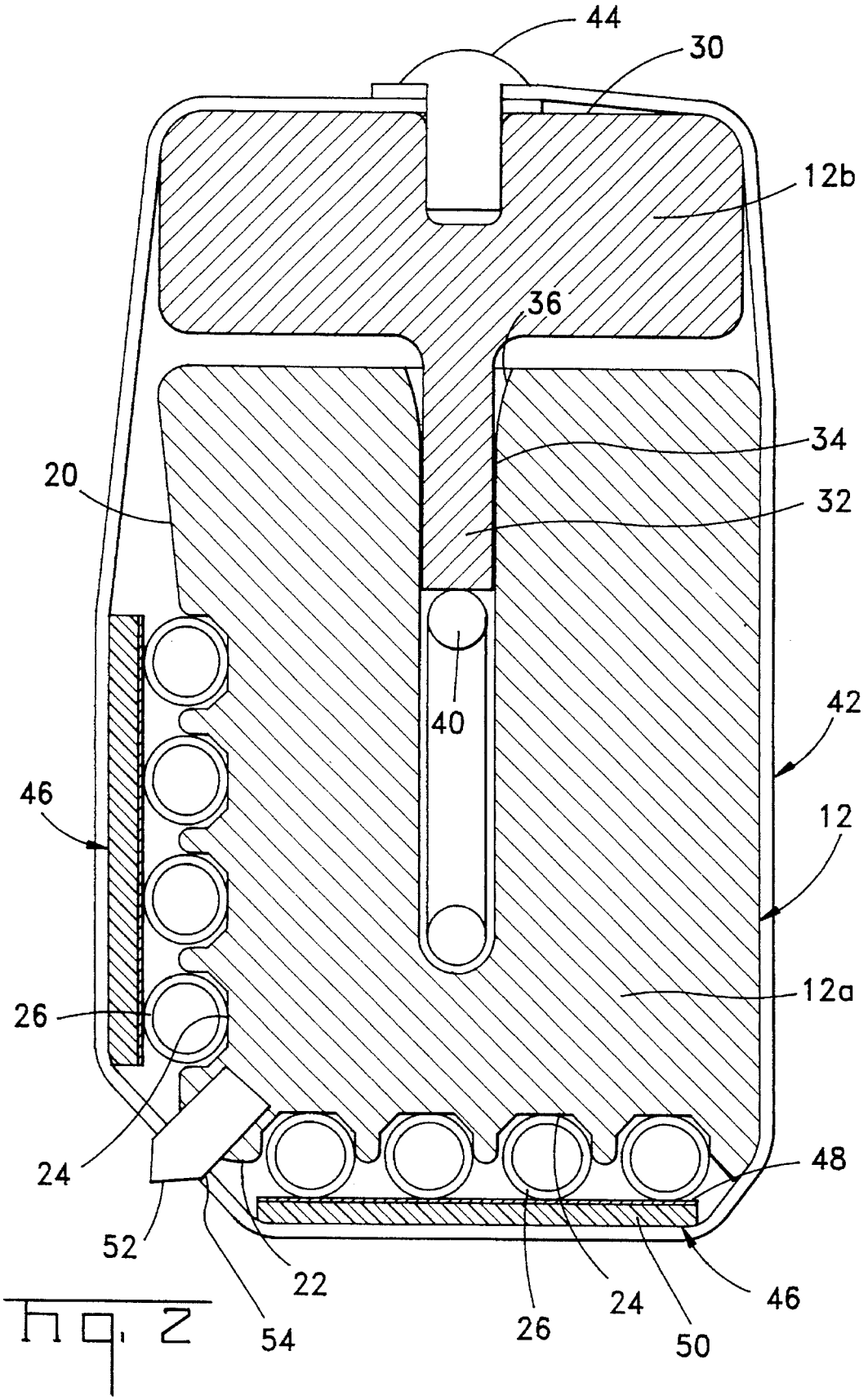
FIG. 2 is an enlarged sectional view of a first embodiment of a two-piece connector housing member according to this invention, where two such housing members are arranged in close proximity to one another to define a planar electronic device slot therebetween.
Figure 3:
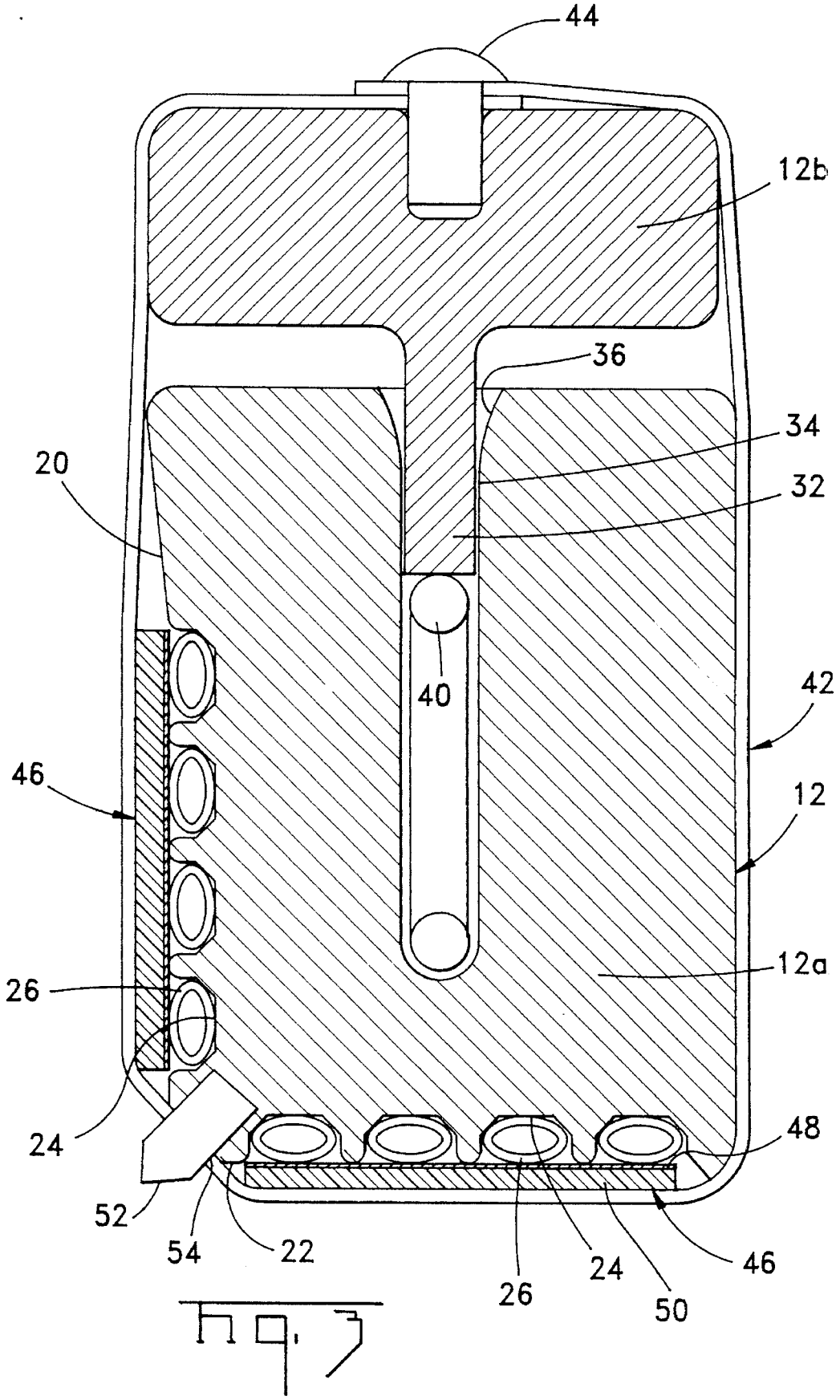
FIG. 3 is an enlarged sectional view, similar to FIG. 2, showing the respective pieces under tension and restrained by a flexible film wrapped thereabout.

The second or upper member 12*b*, as illustrated in FIGS. 2 and 3, may comprise a T-configured member having an upper portion 30 and a lower extension 32 projecting essentially perpendicular thereto. The extension is centrally positioned and arranged to be received in sliding engagement with slot 34 in the first or lower member 12*a*. It will be noted that the slot opening 36 has been flared outwardly to allow a certain degree of rocking or slide movement of the second member relative to the first member, when assembled. The purpose of this will become apparent hereinafter. To effect a floating engagement or relative vertical movement between the first and second members, a spring 40, under compression, may be provided within slot 34, where the compression, of a predetermined degree, is urging the respective members away from one another.

To counteract this tension, and to take advantage of the construction of this connector, a flexible film 42 of a fixed length is wrapped about and secured to the second or upper member by a plurality of pins 44, only one of which is illustrated in FIG. 2. For a detailed explanation of a suitable flexible film for practicing this invention, reference is made to co-pending application Ser. No. 08/299,221 dated Aug. 31, 1994. Very briefly, nevertheless, the preferred flexible film comprises a flexible plastic sheet, such as KAPTON, a registered trademark of DuPont Company, Wilmington, Del., where such sheet is a polymide film on the order of about 2 mils in thickness. A feature of such material is that it can be metallized through plating and etching. A flexible film, as described in said co-pending application, is a composite of the plastic sheet having on a first surface a layer of copper which may act as an electrical grounding trace, and on the opposite surface plural discrete pads or traces of plated copper for electrical connection to the respective planar electronic devices.

Such a composite flexible film 42, with the discrete pads or traces on the outside is wrapped about the assembled first and second members, and canted coil springs, in the manner illustrated in FIG. 2. Strategically placed between the flexible film 42 and the respective sets of canted coil springs 26, are a pair of force integrators 46 consisting of a metal strip or shim 48 and an overlying elastomeric member 50. By the use of the force integrator 46, a more uniform distribution of force between the flexible film and the planar electronic device to which it is electrically interconnected is achieved.

To ensure proper positioning of the flexible film 42 about the assembled members, a pin or pins 52 may be provided at the junction of the slot face 20 and the base face 22 for receipt in a precisely aligned hole or holes 54 in the film 42. In effect, the flexible film 42 is wrapped about the assembled members with reference to the pin(s) 52, then securely fastened to second or upper member 12*b*. By this arrangement, the assembly, with the flexible film thereabout, is positioned for electrically connection along slot face 20 and base face 22.

While FIG. 2 represents the connector under a pre-loaded condition, FIG. 3 illustrates the operating connector housing with the spring 40 exerting a separating force therebetween, where such force is in excess of the card insertion force to engage the card or daughter board in slot 16. It will be noted in FIG. 3 that the first and second members 12*a*, 12*b* are further apart, and that the flexible film 42 is taut thereabout deflecting the underlying canted coils 26.

In use, the housing 12 is mounted to a planar electronic device, or mother board, along the base face 22, whereby to electrically interconnect pads or traces on the flexible film 42 to corresponding pads or circuitry on the mother board. In this position, the respective housings 12 may receive a daughter board in the slot created by the spaced apart housings. Typically, the daughter board is inserted tangentially to the flexible film 42 where it frictionally engages the film overlying the force integrators 46. With the prior art devices, the film would be seen to buckle slightly, much like a wave preceding the forward edge of the daughter board. This buckling was the apparent culprit in work hardening the copper pads or traces, ultimately leading to circuit failure. The present invention avoids this buckling problem by providing a floating housing that maintains the film under tension, where such tension exceeds the force required to insert and interconnect the daughter board. It will be recalled that the respective first and second members 12*a*, 12*b* are assembled to allow a certain degree of rocking or motion therebetween. This is achieved in part by the flared opening 36. Since the film is fixed in position relative to the force integrators, and slack in the film could be different adjacent such force integrators during card insertion, by allowing the rocking motion or some lateral movement in the second member 12*b*, one can compensate or adjust for this difference and still avoid the problems of the prior art.

Figure 4:
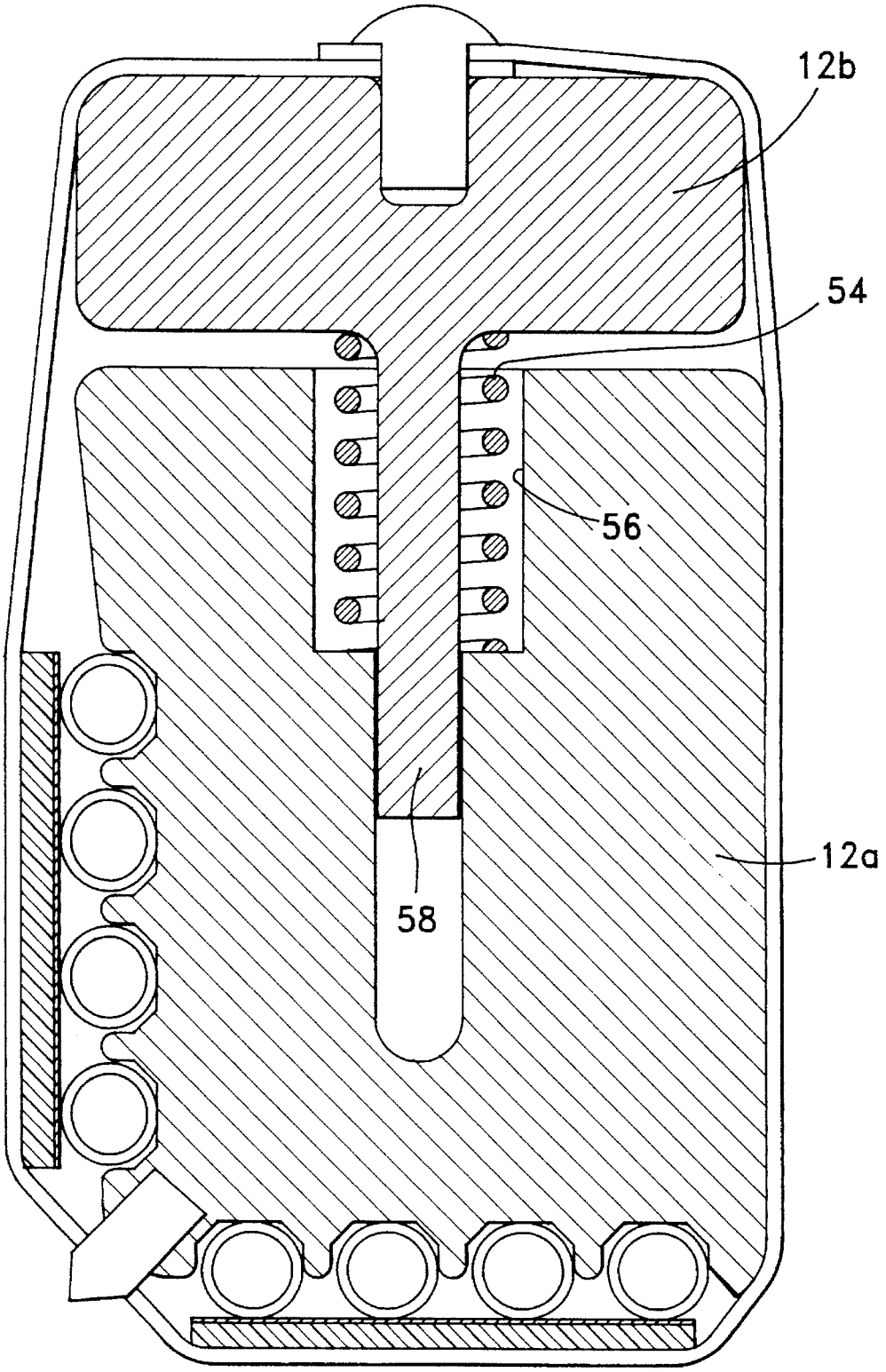
FIG. 4 is an enlarged sectional view, similar to FIG. 2, showing a second embodiment of the tension adjusting means.
Figure 5:
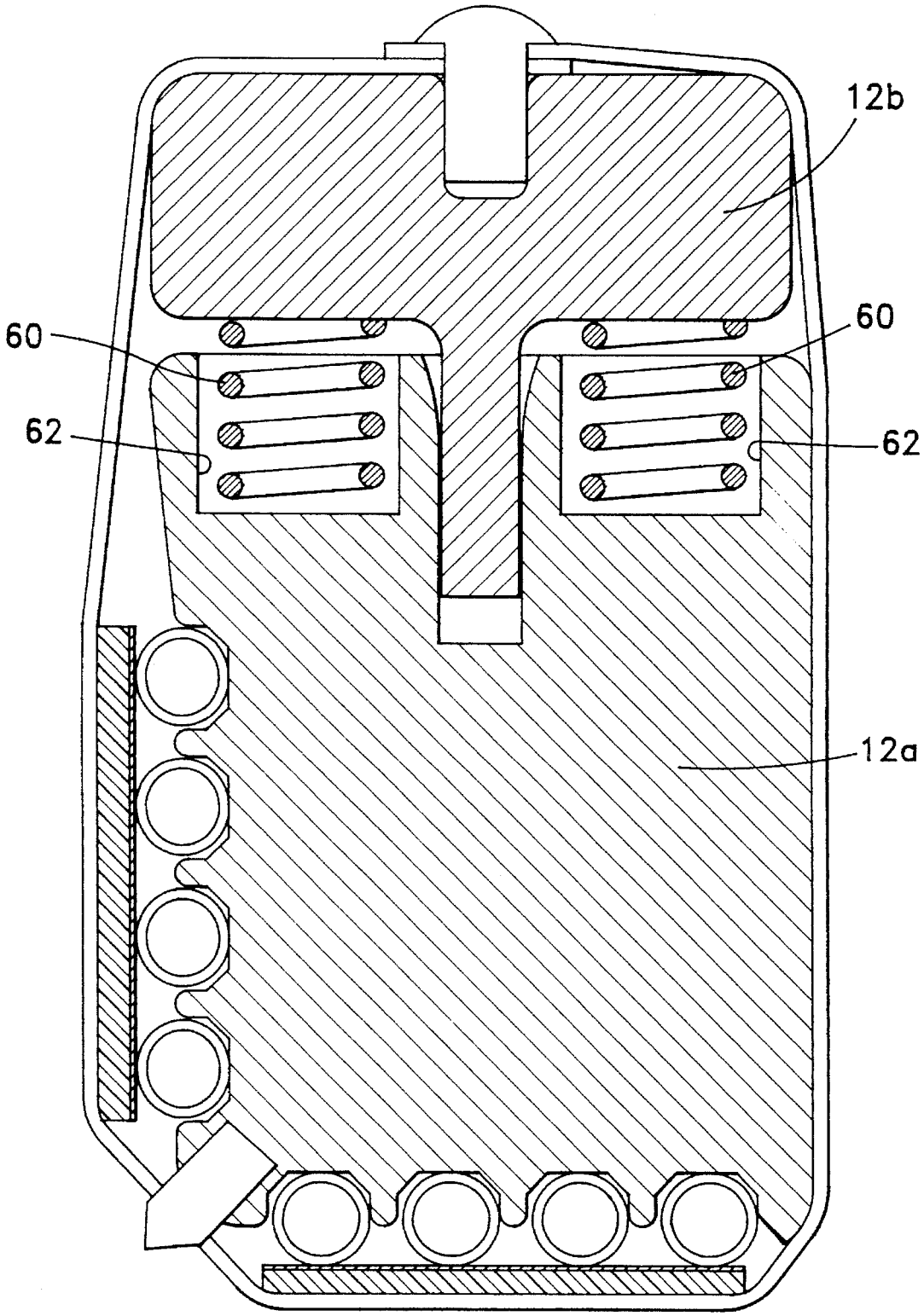
FIG. 5 is an enlarged sectional view, similar to FIG. 2, showing a further embodiment of the tension adjusting means.

FIGS. 4 and 5 represent alternate embodiments to facilitate the floating relationship between the first and second housing members 12*a*, 12*b*. Specifically, in the embodiment of FIG. 4, a central spring 54 may be provided in the broad central recess 56 in first member 12*a*. The second member extension 58 may be continuous with an elliptical spring, or a series of circular posts having a like number of circular springs thereabout. By virtue of the broad recess, where the extension 58 is spaced from the wall of recess 56, the rocking action or relative movement between the first and second members 12*a*, 12*b* is assured. FIG. 5 illustrates the use of plural springs 60, where such springs are positioned in separate recesses 62 offset from the extension and slot arrangement as discussed above in regard to the embodiment of FIG. 2 and 3.

Figure 7:
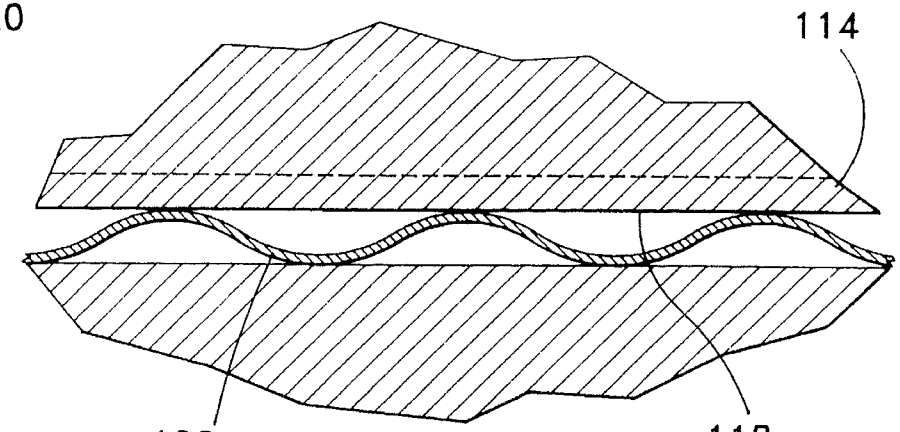
FIG. 7 is a partial longitudinal sectional view of the connector housing illustrated in FIG. 6.
Figure 6:
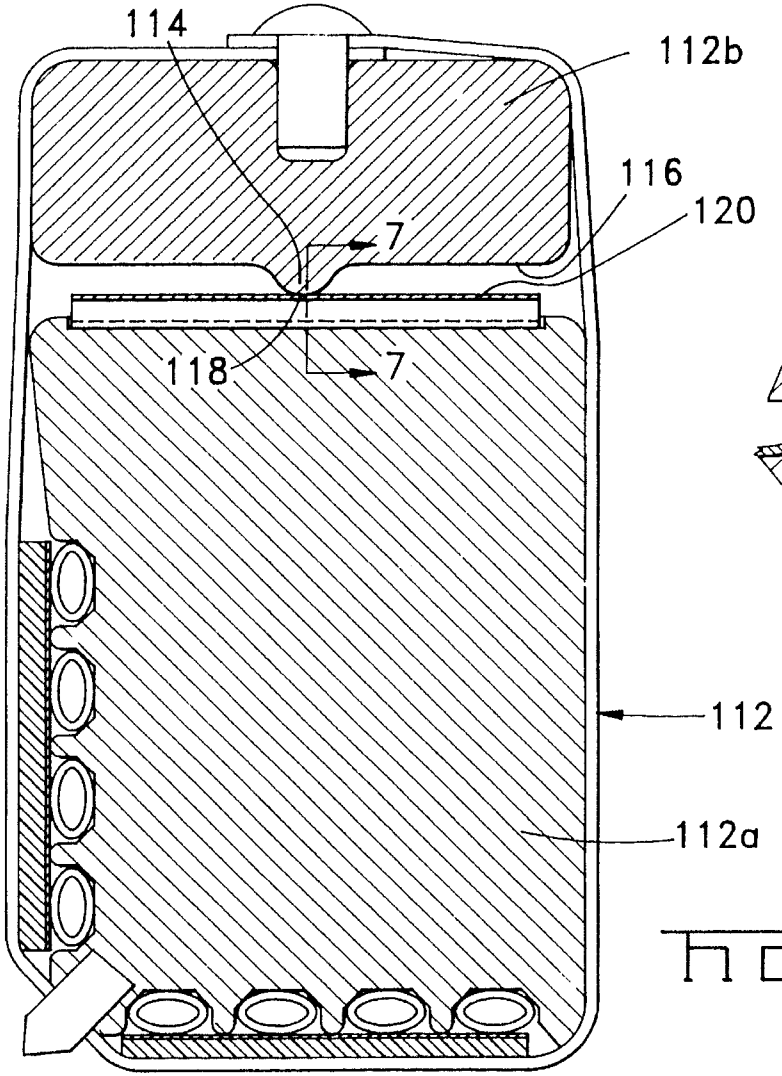
FIG. 6 is an enlarged sectional view, similar to FIG. 2, showing still another embodiment of the tension adjusting means.

FIGS. 6 and 7 illustrate still a further embodiment of the tension adjusting means. In this embodiment, each housing 112 comprises first and second housing members 112*a*, 112*b*, where the second or upper member 112*b* includes a longitudinal rib 114 projecting from the base 116, where the rib is provided with a rounded lower surface 118. Disposed between the first and second housing members, is a sinusoidal configured spring member 120 (see FIG. 7) which features regular peaks and valleys throughout its length. The respective peaks support the second housing member 112*b*, along the rounded lower surface 118. By the use or design of such rounded lower surface, it is possible to achieve the rocking or relative movement between the first and second housing members that is desirable to ensure proper tension on the flexible film.

We claim:

1. An electrical connector of the type for electrically interconnecting a pair of planar electronic devices, said connector comprising:

a pair of opposed housing members having a slot defined by opposing facing surfaces extending therebetween to receive a first of said planar electronic devices, each said housing member consisting of first and second members, where said second member is floatably mounted to said first member by spring means urging said first and second members away from one another, force applying means associated with each said facing surface, and a flexible circuit film member for each said housing member having spaced apart rows of contact pads on a surface thereof, said film member wrapped about a respective first and second member and said force applying means, where said contact pads are exposed to said slot, whereby the separating force of said spring means is greater than the insertion force required to place said first planar electronic device within said slot.

2. The electrical connector according to claim 1, wherein a second surface along said first member is provided with a force applying means.

3. The electrical connector according to claim 2, wherein said force applying means comprises at least one elongated coil spring.

4. The electrical connector according to claim 3, wherein an elastomeric member is provided intermediate said force applying means and said flexible circuit film.

5. The electrical connector according to claim 1, wherein said first member includes a central slot which slidably receives said second member.

6. The electrical connector according to claim 5, wherein said spring means is positioned within said slot to effect a separating action between said respective first and second members.

7. The electrical connector according to claim 5, wherein said first and second members each include a planar surface disposed in close proximity to one another, and that said spring means is positioned therebetween.

8. The electrical connector according to claim 2, wherein said first and second surfaces are angularly disposed from one another, and that means are provided at the junction thereof for aligning said flexible circuit film relative to said force applying means.

9. The electrical connector according to claim 1, wherein said spring means consists of a longitudinally disposed, sinusoidal configured metal spring, and that said second member includes a longitudinally oriented rib along its base in contact with said metal spring.

10. The electrical connector according to claim 9, wherein said rib is provided with a rounded, semi-circular edge in contact with said metal spring.

* * * * *